US008074357B2

(12) United States Patent
Shimazu et al.

(10) Patent No.: US 8,074,357 B2
(45) Date of Patent: Dec. 13, 2011

(54) METHOD FOR MANUFACTURING INK JET RECORDING HEAD

(75) Inventors: Satoshi Shimazu, Kawasaki (JP); Naoya Tsukamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 722 days.

(21) Appl. No.: 12/111,559

(22) Filed: Apr. 29, 2008

(65) Prior Publication Data

US 2008/0295332 A1 Dec. 4, 2008

(30) Foreign Application Priority Data

May 1, 2007 (JP) ..... 2007-121080

(51) Int. Cl.
*B21D 53/76* (2006.01)
*B41J 2/045* (2006.01)

(52) U.S. Cl. ..... 29/890.1; 29/611; 29/841; 29/854; 347/50; 347/58

(58) Field of Classification Search ..... 29/890.1, 29/854, 855, 841, 876, 611; 347/50, 58, 347/59

See application file for complete search history.

(56) References Cited

U.S. PATENT DOCUMENTS 6,084,612 A 7/2000 Suzuki et al.
7,118,199 B2 * 10/2006 Mori ..... 347/58

FOREIGN PATENT DOCUMENTS

JP 60262649 A * 12/1985 ..... 347/50
JP 10-44442 2/1998
JP 2006-167972 6/2006

* cited by examiner

*Primary Examiner* — A. Dexter Tugbang
(74) *Attorney, Agent, or Firm* — Fitzpatrick, Cella, Harper & Scinto

(57) ABSTRACT

A manufacturing method for an ink jet recording head. The method includes the steps of preparing a recording element substrate, preparing an electric wiring member, preparing a sealing material discharging member, and applying a sealing material. The ink jet recording head is constructed to provide a first gap between a recording element substrate and an inner edge of a hole. The first gap is larger than a second gap between the recording element substrate and an opposite inner edge of the hole measured along the same line. The sealing material is applied while moving the sealing material discharging member, along the line, from a portion of an electric wiring member adjacent to the first gap, across the first gap, across the electrical connection portions, across the second gap, to a portion of the electric wiring member adjacent to the second gap.

6 Claims, 9 Drawing Sheets

PRIOR ART

PRIOR ART

METHOD FOR MANUFACTURING INK JET RECORDING HEAD

FIELD OF THE INVENTION AND RELATED ART

The present invention relates to a method for manufacturing an ink jet recording head.

In recent years, an ink jet recording head has come to be widely used in the field of office equipment, for example, a printer, a copying machine, a facsimile machine, and the like. Further, its usage is quickly spreading into the field of industrial systems, such as the field of a textile printing machine.

To briefly describe a method for manufacturing an ink jet recording head, an ink jet recording head is made up of a portion through which ink flows, and a portion from which ink is ejected. The former and latter may hereafter be referred to as an ink passage portion and an ink ejection element portion. The two portions are manufactured independently from each other, and then, are joined to yield an ink jet recording head (Japanese Laid-open Patent Application H10-44442). Referring to FIG. 7A, this type of ink jet recording head has a recording element chip 101 and an electrical wiring tape 110. The recording element chip 101 has heat generating resistors, etc. The recording element chip 101 is electrically connected to the electrical wiring tape 110 through a pair of electrical junctions which are next to the edges of the recording element chip 101, one for one, which are perpendicular to the direction in which the ejection nozzles of the recording element chip 101 are arranged in a straight line or straight lines.

Next, referring to FIG. 7B, the junctions between the electrical lead wires 112 of the electrical wiring tape 110, and the corresponding electrode portion 102 of the recording element chip 101, are covered with a body of second sealant 131. Further, the gap between the recording element chip 101 and the electrical wiring tape 110 is filled with a body of first sealant 130 or the like, in order to prevent ink from reaching the back side of the recording element chip 101.

Referring again to FIG. 7A, the electrical wiring tape 110 is provided with a hole for accommodating the recording element chip 101. In order to make it easier to apply the second sealant 131 with the use of a needle, this hole of the electrical wiring tape 110 is made large enough to provide a substantial amount of gap between the edges of the hole and the corresponding edges of the recording element chip 101. That is, unless the gaps are substantial, it is highly possible that the needle of a sealant applying apparatus will not fit into the gaps, and therefore, will fail to properly place the sealant in the gaps, and/or that the needle will collide with the edges of the recording element chip 101, which may result in the cracking of the chip 101.

As described above, an ink jet recording head, such as the one described one, which is in accordance with the prior art, is structured so that there is a substantial amount of gap between the recording element chip 101 and electrical wiring tape 110. Thus, it sometimes occurs that when sealing the electrical junctions between the recording element chip 101 and electrical wiring tape 110, the body of second sealant 131 sags toward the body of first sealant 130, which is under the body of second sealant 131, as shown in FIG. 7B. If the second sealant 131 sags toward the body of first sealant 130, it fails to properly cover the electrical lead wires 112, that is, it allows some electrical lead wires 112 to remain partially or fully exposed, making it therefore possible for some electrical lead wires 112 to be corroded by ink.

Also, even if it is possible to precisely apply the second sealant 131, it is still possible that as the first and second sealants are simultaneously hardened, the body of second sealant 131 will crack by being pulled downward at its lengthwise ends by the body of first sealant 130 which shrinks as it hardens. If the body of second sealant 131 cracks, it is possible that ink will seep to the electrical lead wires 112 and corrode the lead wires 112, as it does if the electrical lead wires 112 remain partially or fully exposed as described above. Thus, the step of applying the second sealant 131, and the step of hardening the second sealant 131, has to be carried out after the hardening of the body of first sealant 130. This is problematic in that not only does it add to the number of steps necessary to manufacture an ink jet recording head, but it also adds to the number of apparatuses to be prepared for the manufacture of an ink jet recording head.

Referring to FIGS. 8A and 8B, one of the solutions to this problem is to minimize the effect of the shrinkage of the first sealant 230, which occurs as the first sealant 230 hardens. As one of the means for minimizing the effect of the shrinkage of the first sealant 230, it is possible to structure an ink jet recording head so that the electrical wiring tape 210 is positioned to be sandwiched by the body of first sealant 230 and the body of second sealant 231. As long as the electrical wiring tape 210*a* remains sandwiched by the first and second bodies of sealants 230 and 231, respectively, the problem, such as the cracking of the body of first sealant 230 and/or body of second sealant 231, does not occur even if the two bodies of sealant are hardened simultaneously.

However, the solution described above creates a new problem. That is, referring to FIG. 8C, as the second sealant 231 is applied, the body of applied second sealant 231 became narrow across a portion 232, because of the presence of a step between the electrical wiring tape 210 and recording element chip 201. This step is necessary to prevent the problem that the contact between the surface (which hereafter will be referred to as main surface) of the recording element chip 201, at which the outward end of each ink ejection nozzle opens, and the recording medium, which might occur if the recording medium fails to be properly conveyed because of a paper jam or the like, damages the main surface of the recording element substrate, etc. The step is also necessary from the standpoint of preventing the direct contact between the electrical lead wires extending from the edges of the abovementioned hole of the electrical wiring tape 210, and the recording medium element chip 201.

The body of applied second sealant 231 is likely to narrow across the portion 232 when the needle for applying the second sealant 231 is moved past the step in the direction to move from the higher level (top surface of electrical wiring tape) toward the lower level (main surface of recording element chip). As a part (232) of the body of applied second sealant 231 becomes narrow, the portion 232 of the body of second sealant 231 may fail to completely cover all the electrical lead wires 212; some electrical lead wires 212 may remain fully or partially exposed. If any of the electrical lead wires 212 remains exposed, it is possible that the electrical lead wire 212 will be corroded by ink. As one of means for preventing the part of body of applied second sealant 231, which corresponds in position to the step, from narrowing, it is possible to increase the amount by which the second sealant 231 is applied. However, increasing the amount by which the second sealant 231 is applied results in the increase in the height of the body of applied second sealant 231, making it necessary to increase the distance between the ink jet recording head and recording medium, in order to prevent the recording medium from coming into contact with the main surface of the ink jet recording head. This is problematic in that the increase in the distance between the ink jet recording head (main surface) and recording medium reduces the accuracy with which an ink droplet ejected from the ink jet recording head lands on the recording medium, which in turn lowers the level of quality at which an image is formed by the ink jet recording head.

As another means for preventing the above described problem, it is possible to reduce the second sealant 231 in viscosity. However, this method allows the body of applied second sealant 231 to spread wide enough to flow into the ejection nozzles and plug them.

Further, reducing the second sealant 231 in viscosity results in the formation of a thinner body of second sealant 231, which is less effective to keep the electrical junctions sealed. Thus, reducing the second sealant 231 in viscosity may allow ink to reach the electrical junctions and corrode the electrical lead wires 212.

Further, as another means for preventing the abovementioned problem, it is possible to modify the line of movement which the needle is to follow when applying the second sealant 231. That is, it is possible to move the needle in a manner to follow the line indicated by an arrow mark b in FIG. 8D to increase the amount by which the second sealant 231 is applied across the area of the ink jet recording head, which corresponds in position to the step. Applying the second sealant 231 in a manner to follow the arrow mark b can somewhat reduce the extent to which the portion 232 of the body of the applied second sealant 231 narrows. However, this solution makes it difficult to control the amount by which the second sealant 231 is to be applied, and the line to be followed by the sealant application needle. The estimation of the length of time which will be required if this solution is applied to an actual production line of an ink jet recording head revealed that the application would unignorably increase the length of time the production line has to be operated.

Also concerning the solution to the above described problem, Japanese Laid-open Patent Application 2006-167972 discloses an ink jet recording head structured as shown in FIG. 9. The recording element chip 301 of this ink jet recording head is also positioned so that it fits in the hole of the electrical wiring tape 302 (which is made up of flexible substrate (film), and flexible wiring formed on flexible substrate). Further, in terms of the direction in which the electrodes 303 of the recording element chip 301, which are for making electrical connection between the chip 301 and the electrical wiring tape 303, are aligned, the gap between one end of the electrical junction and the corresponding edge of the electrical wiring tape 302 is different from the gap between the other end of the electrical junction and the corresponding edge of the electrical wiring tape 302. In this case, it is from the side where the gap is smaller toward the side where the gap is larger that the needle is moved to apply the sealant. However, this method of applying sealant to the recording element chip cannot prevent the portion 232 of the body of applied sealant from narrowing.

SUMMARY OF THE INVENTION

Thus, the primary object of the present invention is to provide a method for manufacturing an ink jet recording head, which can prevent the problem that the electrical junction between the recording element chip and electrical wiring tape of an ink jet recording head is unsatisfactorily sealed.

According to an aspect of the present invention, there is provided a manufacturing method for an ink jet recording head, comprising preparing a recording element substrate provided with energy generating means for generating energy for ejecting liquid, two opposing sides opposed to each other, an electrode portion disposed along a side sandwiched between said opposing sides to supply electric power to said energy generating means; preparing an electric wiring member provided with wiring leads for supplying electric power to said electrode portion from an outside, said electric wiring member being provided with sides opposed to said opposing sides of said recording element substrate and to said side sandwiched between said opposing sides; forming an electrical connecting portion at least one of said opposing sides by connecting said electrode portion and said wiring lead with each other; providing a gap L1 between one of said opposing sides of said recording element substrate and said side of said electric wiring member opposing said one of said opposing sides, and providing a gap L2 between the other one of said opposing sides and said side of said electric wiring member opposing the other one of said opposing sides, wherein the gap L1 is larger than the gap L2, and wherein said electrical connecting portion is interposed between the gap L1 and the gap L2; and supplying a sealing material in a direction from the gap L2 toward the gap L2 through said electrical connecting portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Figure 1B:
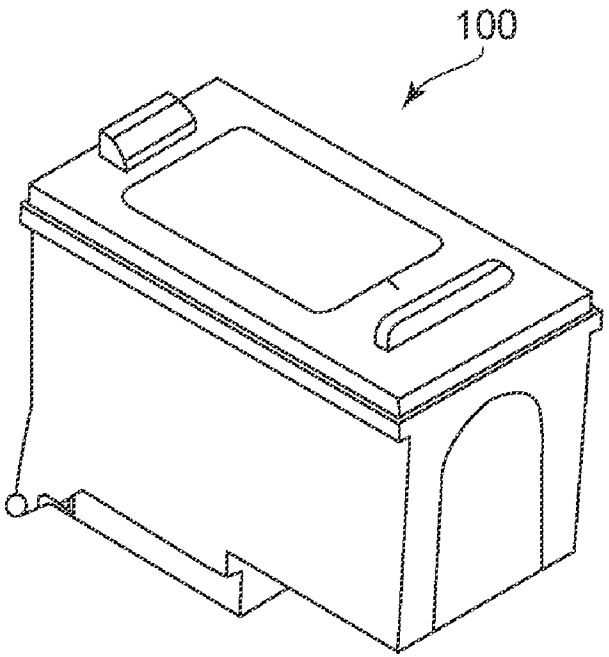
FIGS. 1A and 1B are external perspective views of an ink jet recording head to which the present invention is applicable.
Figure 1A:
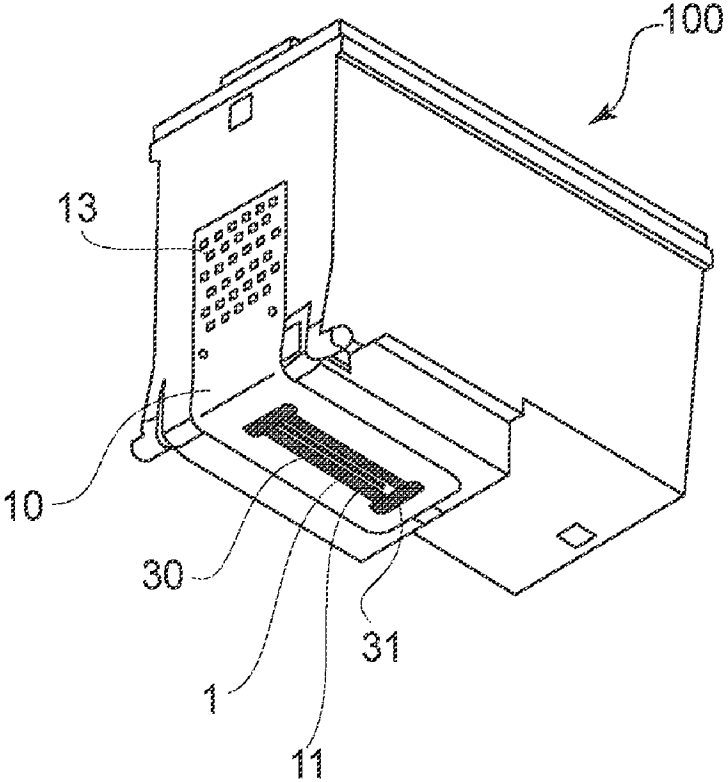

FIGS. 1A and 1B are external perspective views of an ink jet recording head to which the present invention is applicable.

Referring to FIG. 1, the ink jet recording head 100, which is in accordance with the present invention, is made up of an ink container portion and a recording head portion, which are integral with each other. The ink jet recording head 100 is rigidly and removably held to the carriage of the main assembly of the ink jet recording apparatus by the head positioning means of the carriage, which is the head holding member of the carriage, and the electrical contacts of the main assembly.

Next, each of the various structural components of this ink jet recording head will be described in more detail.

The recording element chip 1 has multiple ink ejection nozzles 3, which are arranged in one or more straight columns. It has four edges, that is, a pair of edges parallel to the column(s) of ink ejection nozzles, and a pair of edges perpendicular to the column(s) of ink ejecting nozzles. It is provided with a pair of electrode portions for supplying the energy generating means of the recording element chip 1 with electrical power. The electrode portions are along the two edges of the recording element chip 1, one for one, which are parallel to the column(s) of ink ejection nozzles. Further, the recording element chip 1 is provided with electrothermal transducers, which are the means for generating the energy for ejecting ink, and wiring for sending to each of the electrothermal transducer the electrical signals and/or the electrical power for generating heat. The electrothermal transducers and ink ejection nozzles are positioned in a manner to oppose each other, one for one.

The electrical wiring tape 10, which is an electricity distributing member, is provided with edges, which are parallel to the edges of the recording element chip 1, which are parallel to the column(s) of ink ejection nozzles, and edges which are perpendicular to the edges of the recording element chip 1, which are parallel to the column(s) of ink ejection nozzles. The electrical wiring tape 10 provides passages (wiring) through which external electrical power and/or electrical signals for ejecting ink are transmitted to the electrode portions 2 of the recording element chip 1.

The electrical wiring tape 10 is provided with a hole 11 for accommodating the recording element chip 1. The electrical wiring tape 10 is provided with lead wires 12 (electrical terminal in the form of wire), which perpendicularly extend inward of the abovementioned hole from the opposing two edges of the hole, which are perpendicular to the lengthwise direction of the recording element chip 1. The lead wires 12 are to be connected to the electrode portion 2 of the recording element chip 1. Further, the electrical wiring tape 10 is provided with external signal input terminals 13, which are external terminals through which the recording element chip 1 receives the electrical signals from the unshown apparatus main assembly. The electrical wires 12 are in connection with the external signal input terminals 13, one for one, through the wiring formed of copper foil by patterning.

The electrical connection between the electrical wiring tape 10 and recording element chip 1 is established by welding the electrical wires 12 of the electrical wiring tape 10 to the bumps of the electrode portions 2 (FIG. 3A) of the recording element chip 1, one for one, with the application of pressure and ultrasonic waves.

From the standpoint of improving manufacturing efficiency, the bumps of the electrode portion 2 of the recording element chip 1 may be formed by plating, and electrically connected to the electrical lead wires 12 of the electrical wiring tape 10 by gang bonding.

Embodiment 1

First, referring to FIGS. 2-5 and Tables 1-3, the first embodiment of the present invention will be described.

Figure 2A:
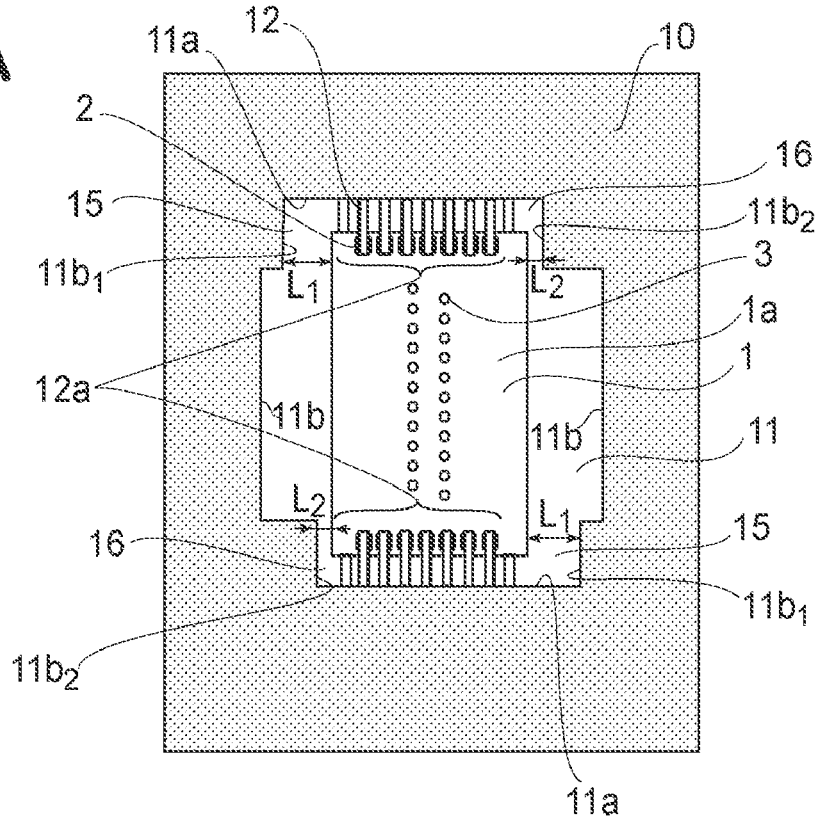
FIGS. 2A and 2B are plan views of the electrical wiring portion of the ink jet recording head in the first embodiment of the present invention, before and after, respectively, the application of the sealants.
Figure 3A:
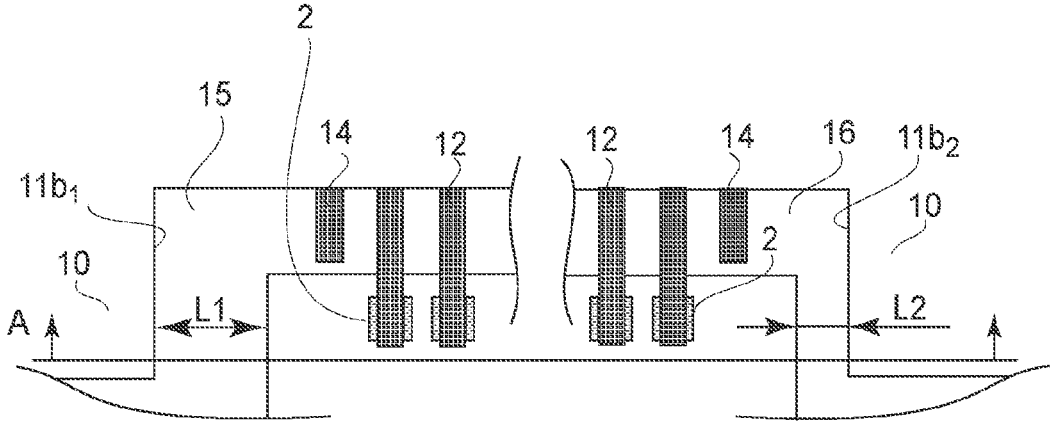
FIGS. 3A and 3B are an enlarged plan view and a sectional view, respectively, of a part of the electrical wiring portion.
Figure 3B:
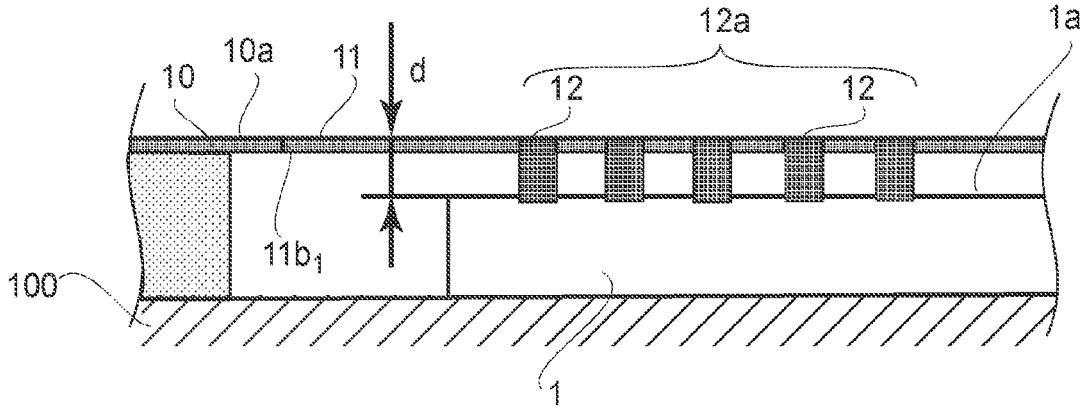

FIG. 2A is a plan view of the electrical wiring portion of the ink jet recording head prior to the application of the sealants. FIG. 3A is an enlarged plan view of a part of the electrical wiring portion, and FIG. 3B is an enlarged sectional view of the portion of the ink jet recording head at Line A-A in FIG. 3A.

First, referring to FIG. 2A, the shape of the hole 11 of the electrical wiring tape 10, and the positional relationship between the hole 11 and the recording element chip 1, will be described in detail.

The hole 11 of the electrical wiring tape 10 has a pair of mutually opposing straight edges 11*a*, and a pair of mutually opposing straight edges 11*b*. The edges 11*a* are perpendicular to the edges 11*b*.

There is a pair of electrical junctions 12*a*, on the edge portions of the recording element chip 1, one for one, which are parallel to the edges 11*a*. Each electrical junction 12*a* is made up of multiple electrical lead wires 12. Incidentally, there may be only a single electrical junction 12*a*, which opposes at least one section of the pair of edges 11*a* of the electrical wiring tape 10. In this embodiment, the electrical wiring tape 10 is provided with two sets of multiple electric lead wires 12, which perpendicularly extend from the edges 11*a* of the hole 11 of the electrical wiring tape 10, one for one. Further, the electrical wiring tape 10 is provided with two pairs of dummy lead wires 14, which also perpendicularly extend from the two edges 11*a* of the electrical wiring tape 10, one for one. The dummy lead wire 14 is at each end of the group of electrical leads 12, in terms of the direction parallel to the edges 11*a*. The electrical junction 12*a* is the junction between the group of electrical lead wires 12 and the group of electrodes of the recording element chip 1. Thus, the electrical junctions 12*a* extend along the edges of the recording element chip 1, one for one, which are parallel to the edges 11*a* of the hole 11 of the electrical wiring tape 10.

The hole 11 of the electrical wiring tape 10 has also a pair of edges 11*b*1 (first edges), which oppose each other diagonally across the hole 11, and a pair of edges 11*b*2 (second edges), which oppose each other also diagonally across the hole 11. The edges 11*b*1 and edges 11*b*2 are parallel to each other. Further, in terms of the direction parallel to the edges 11*a* of the hole 11 of the electrical wiring tape 10, one of the lengthwise ends of one of the electrical junctions 12 opposes one of the two edges 11*b*1, whereas the other lengthwise end of the electrical junction 12 opposes one of the two edges 11*b*2. Further, one of the lengthwise ends of the other electrical junction 12 opposes the other edge 11*b*1, whereas the other lengthwise end of the other electrical junction 12 opposes the other edge 11*b*2. Thus, each electrical junction 12*a* is perpendicular to the corresponding edges 11*b*1 and 11*b*2.

Further, the hole 11 is shaped so that a gap L1, which is the gap between the first edge 11*b*1 and recording element chip 1 is wider than a gap L2, which is the gap between the second edge 11*b*2 and recording element chip 1.

There is a space 15, which is the space between the first edge 11*b*1 and the corresponding end of the electrical junction 12*a*. There is also a space 16, which is the space between the second edge 11*b*2 and the corresponding edge of the electrical junction 12*a*. In terms of the direction parallel to the edge 11*a*, the space 15 is on the side from which the application of the sealant is started, and the space 16 is on the side on which the application of the sealant is ended.

Figure 2B:
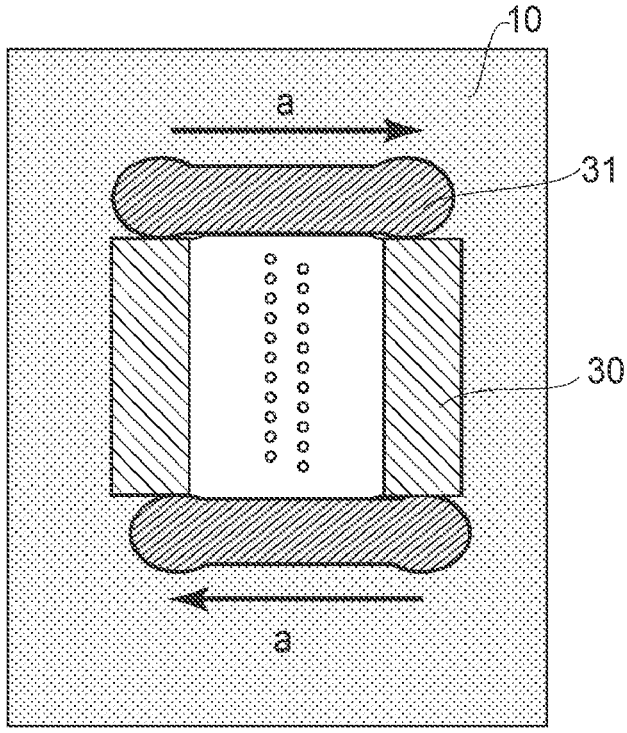

FIG. 2B is a plan view of the electrical wiring portion of the ink jet recording head after the application of the sealants.

The first sealant 30 is applied in a manner to seal the gaps between the edges of the hole 11 of the electrical wiring tape 10 and corresponding edges of the recording element chip 1. The second sealant 31 is applied to seal the electrical junction 12*a* after the application of the first sealant 30. Incidentally, the application of the second sealant 31 may be started before the first sealant 30 is hardened. The first and second sealants 30 and 31 can be roughly equalized in the shrinkage which occurs as they harden, by choosing their fillers and adjusting the amount by which the fillers are added. Therefore, it is possible to prevent the problem that the bodies of the applied first and second sealants 30 and 31 crack as they harden, and also, it is possible to ensure that the hardness of the bodies of the applied first and second sealants 30 and 31 remains stable at a desired level.

In this embodiment, the second sealant 31 is applied with the use of a single needle 20 (FIG. 4), through which the sealant 31 is extruded. Referring to FIG. 2B, the needle 20 is moved from the side where the first edge 11*b*1 is, toward the second edge 11*b*2, through the space above the electrical junction 12*a*, as indicated by an arrow mark b in the drawing. That is, the application of the second sealant 31 is started from the area of the top surface of the electrical wiring tape 10, which is next to the first edge 11*b*1. Then, it is continued to cover the body of first sealant 30 in the space 15 (that is, the space on the side from which the application of the second sealant 31 is started), electrical junction 12*a*, body of first sealant in the space 16 (that is, the space on the side on which the application of the second sealant 31 is ended), and area of the top surface (main surface 10*a*) of the electrical wiring tape 10, which is next to the second edge 11*bb*. Similarly, the second sealant 31 is applied to the other electrical junction 12*a*, that is, the electrical junction 12*a* next to the other edges 11*a* (FIG. 2B).

As described above, in this embodiment, the gap L1, that is, the gap between the edge 11*b*1 and corresponding edge of the recording element chip 1, is greater than the gap L2, that is, the gap between the edge 11*b*2 and corresponding edge of the recording element chip 1. In terms of the lengthwise direction of the electrical junction 12*a*, the gap L1 is at one end of the electrical junction 12*a*, and gap L2 is at the other end. Further, the ink jet recording head 100 is provided with at least one electrical junction 12*a*, which opposes one of the edges 11*a*. Further, the application of the second sealant 31 for sealing the electrical junction 12*a* between the electrode portions 2 of the recording element chip 1 and the group of the lead wires of the electrical wiring tape 10 is started on the side where the gap L1 is, and is continued toward the gap L2 across the electrical junction 12*a*. That is, it is started on the side where the gap between the edge of the hole 11 of the electrical wiring tape 10, which is perpendicular to the edge 11*a* of the hole 11 of the electrical wiring tape 10, and the corresponding edge of the recording element chip 1, is greater; it is started on the side where space 15 is. Then, it is continued toward the side where the gap between the edge of the hole 11 of the electrical wiring tape 10, which is perpendicular to the edge 11*a* of the hole 11 of the electrical wiring tape 10, and the corresponding edge of the recording element chip 1, is smaller; it is continued toward the side where space 16 is.

At this time, referring to FIG. 3B, the relationship in position between the top surface of the electrical wiring tape 10 and the top surface of the recording element chip 1 in terms of their thickness direction will be described.

The ink jet recording head 100 is structured so that the surface (main surface 1*a*) of the recording element chip 1, where the outward end of each ejection nozzle 3 opens, is closer to the main assembly of the ink jet recording head 100 than the main surface 10*a* of the electrical wiring tape 10. Because of this structural arrangement, there is a step d between the main surface 1*a* of the recording element chip 1 and the main surface 10*a* of the electrical wiring tape 10. The step d is intentionally provided to prevent the problem that the ejection nozzles 3 are scarred by the collision or the like between the recording medium and the main surface 1*a* of the recording element chip 1. Should the ejection nozzles 3 be scarred, ink droplets are twisted as they are ejected from the ejection nozzles. This is why the step d is provided between the main surface 1*a* of the recording element chip 1, that is, the surface of the recording element chip 1, at which the outward end of each ejection nozzle 3 opens, and the main surface 10*a* of the electrical wiring tape 10. In other words, the step d is necessary to eliminate the cause of the scarring of the main surface 1*a*, that is, the contact between the main surface 1*a* and recording medium, which is likely to be caused by a paper jam or the like, which occurs during a recording operation.

Next, the narrowing of the body of applied second sealant 31, which occurs as the second sealant 31 is applied, will be discussed with reference to the following experiments in which the second sealant 31 was applied to the ink jet recording head in this embodiment. It should be noted here that the two different sealants used in the following experiments are usable for actual manufacturing of the ink jet recording head in this embodiment. The sealant which is used as the second sealant 31 is desired to be in a range of 150 Pa×s-350 Pa×s at 25° C., preferably, 200 Pa×s-300 Pa×s, in viscosity.

Table 1 shows the results of the experiments in which the gap L1 was varied, with the height of the step d kept at 0.1 mm, to find out the value of the gap L1, beyond which the body of applied second sealant 31 did not narrow across the portion which corresponds to the recording element chip 1. As for the evaluation symbols in Table 1, E indicates that it was not the portion of body of applied second sealant 31, which was on the recording element chip 1, but, the portion of body of applied second sealant 31, which was on the body of first sealant 30, that narrowed; G indicates that the body of applied second sealant 31 narrowed across the portion close to the borderline between the recording element chip 1 and the body of first sealant 30; and F indicates that the body of second sealant 31 narrowed across the portion on the recording element chip 1.

TABLE 1

| d = 0.1 mm | | | | | |
|---|---|---|---|---|---|
| | Gap L1 | | | | |
| | 0.1 mm | 0.3 mm | 0.5 mm | 0.7 mm | 0.9 mm |
| narrowing | F | F-G | G | G | G |
| | | | First sealant narrowing | | |

It is desired that the gap L1 is greater than the distance which the point of the body of second sealant 31, which is extruded from the needle 20 when the needle 20 moves past the first edge 11*b*1, has to move to reach the surface of the body of first sealant 30 before the needle 20 reaches the recording element chip 1.

It became evident from these results that as long as the gap L1 is no less than 0.5 mm, it is not the portion of the body of second sealant 31, which is on the recording element chip 1, but, the portion of the body of second sealant 31, which is on the body of first sealant 30, that narrows.

At this time, referring to FIGS. 4A and 4B, what the inventors of the present inventions conceptualized or hypothesized regarding the main cause of the narrowing of the body of applied second sealant 31 will be described.

Figure 4A:
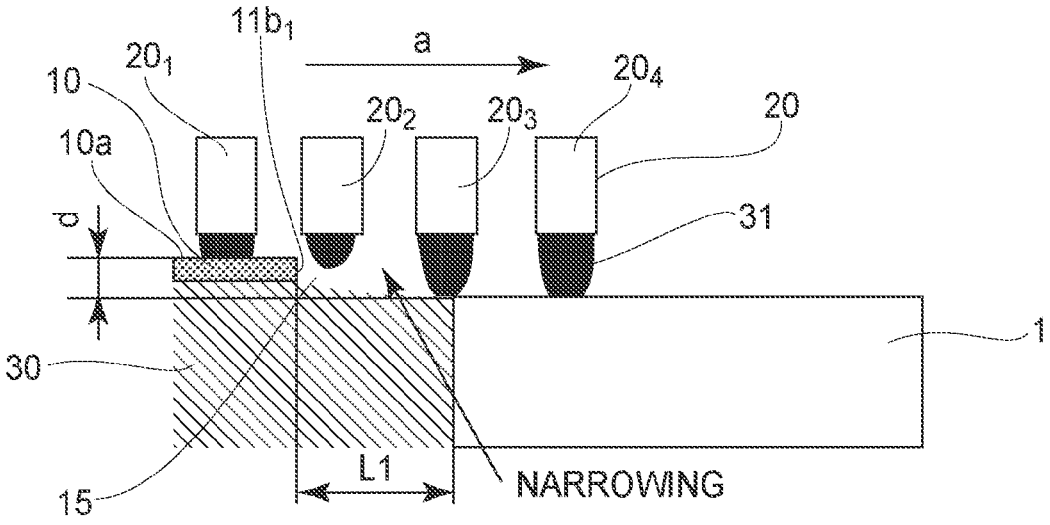
FIGS. 4A and 4B are schematic drawings which show how the second sealant is applied to the upstream (in terms of direction in which sealant application needle is moved) end portion of the area to which the second sealant is to be applied.
Figure 4B:
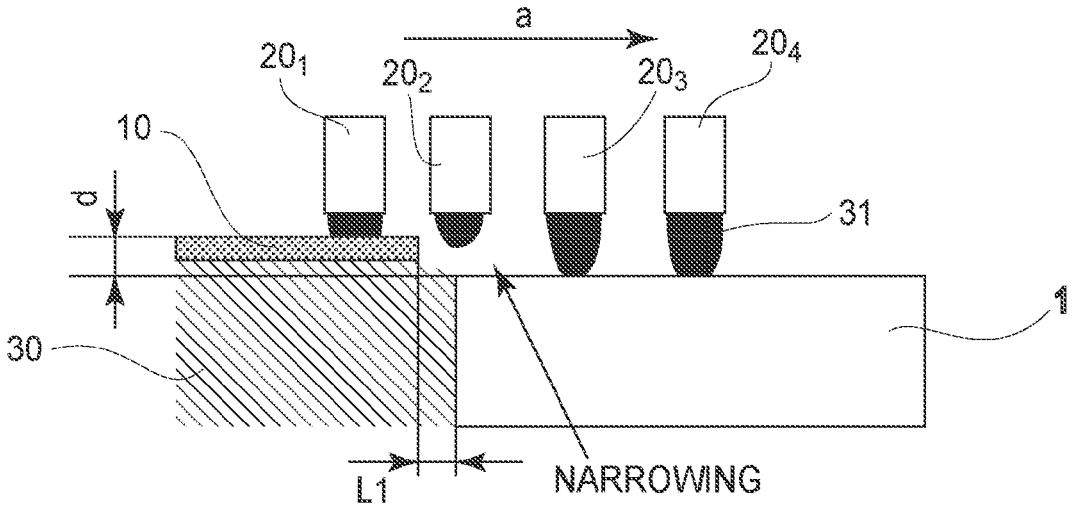

FIGS. 4A and 4B are enlarged schematic sectional views of the space 15 portion of the ink jet recording head 100, which is shown in FIG. 3A, at Line A-A in FIG. 3A. FIG. 4A represents a case in which the gap L1 is relatively large, and FIG. 4B represents a case in which the gap L1 is relatively small. Incidentally, although FIGS. 4A and 4B show four needles $\mathbf{20}_1$-$\mathbf{20}_4$, only one needle 20 is used to apply the second sealant 31. That is, FIGS. 4A and 4B are time-lapse drawings of the needle 20 which is being moved in the direction of the arrow mark a while extruding the second sealant 31.

When the needle 20 is in the position indicated by the needle $\mathbf{20}_1$, the tip of the body of second sealant 31 is already in contact with the surface (main surface 10*a*) of the electrical wiring tape 10.

However, when the needle 20 is in the position indicated by the needle $\mathbf{20}_2$, that is, right after the needle 20 moved past the first edge 11*b*1 of the electrical wiring tape 10, the tip of the body of second sealant 31 has not reached the surface of the body of first sealant 30. The distance from the tip of the needle 20 to the surface of the body of first sealant 30 is greater by the height of the step d than the distance from the tip of the needle 20 to the main surface 10*a* of the electrical wiring tape 10. Thus, as the second sealant 31 is extruded from the needle 20, the body of the extruded second sealant 31 settles in a manner to fill the space created by the presence of the step d. However, the needle 20 is being moved from the position indicated by the needle $\mathbf{20}_2$ toward the position indicated by the needle $\mathbf{20}_3$. Therefore, the amount of the second sealant 31 extruded while the needle 20 is moved from the position indicated by the needle $\mathbf{20}_2$ to the position indicated by the needle $\mathbf{20}_3$ is insufficient to fill the space created by the presence of the step d. This is thought by the inventors of the present invention to be the main cause of the narrowing of a part of the body of applied second sealant 31. In the case of the narrowing shown in FIG. 4A, it is the portion of the body of second sealant 31, which is on the body of first sealant 30, that narrows, whereas in the case of the narrowing shown in FIG. 4B, it is the portion of the body of second sealant 31, which is on the recording element chip 1, that narrows.

The experiments similar to the above described ones were carried out to test an ink jet recording head (100), which is 0.05 mm in the height of the step d. The results are shown in Table 2. Incidentally, the meanings of the symbols E, G, and F in Table 2 are the same as the meanings of those in Table 1, respectively.

TABLE 2

| d = 0.05 mm | | | | | | |
|---|---|---|---|---|---|---|
| | Gap L1 | | | | | |
| | 0.1 mm | 0.2 mm | 0.25 mm | 0.3 mm | 0.5 mm | 0.7 mm |
| narrowing | | F-G | G | G | G | G |
| | | | | First sealant narrowing | | |

Also in the case of these experiments, the results of which are shown in Table 2, the gap L1 was varied to find out the value for the gap L1, beyond which the body of applied second sealant 31 did not narrow across the portion which is on the recording element chip 1. It became evident from these results that as long as the gap L1 is no less than 0.25 mm, it is not the portion of the body of second sealant 31, which is on the recording element chip 1, but, the portion of the body of second sealant 31, which is on the body of first sealant 30, that narrows.

The following were confirmed from the results given in Tables 1 and 2. Paying attention to the relationship between the value of the gap L1 and the value of the height of the step d (between the recording element chip 1 and electrical wiring tape 10) revealed that as long as the value of the gap L1 is no less than five times the value of the height of the step d, the narrowing occurs to the portion of the body of second sealant 31, which is on the body of first sealant 30, but, does not occur to the portion of the body of second sealant 31, which is on the recording element chip 1.

Further studies of the results revealed that if the gap L2, that is, the gap between the recording element chip 1 and electrical wiring tape 10 on the side where the application of the second sealant 32 is ended, that is, on the gap 16 side, is greater than a certain value, it is impossible to scrape the body of first sealant 30 or second sealant 31, which has adhered to the tip of the needle 20, away from the needle 20, by the electrical wiring tape 10.

Table 3 shows the results of the experiments in which the gap L2 was varied to find out the value for the gap L2, beyond which the body of sealant or sealants having adhered to the tip of the needle 20 cannot be separated from the tip. As for the evaluation symbols in Table 3, E indicates that the sealant having adhered to the tip of the needle was satisfactorily removed; G indicates that the removal of the sealant was fair; and F indicates that the removal of the sealant was unsatisfactory.

TABLE 3

| d = 0.1 mm, 0.05 mm | | | | |
|---|---|---|---|---|
| | Gap L1 | | | |
| | 0.1 mm | 0.3 mm | 0.5 mm | 0.7 mm |
| Deposition to needle tip | G | F-G | F | F |

It was evident from the results given in Table 3 that unless the gap L2 is no more than 0.3 mm, a small amount of unhardened first sealant 30 remains adhered to the tip of the needle 20. If the body of first sealant 30 having adhered to the tip of the needle 20 during the step in which one of the electrical junctions 12*a* is sealed remains adhered to the tip, it is possible that the area of the main surface 10*a* of the electrical wiring tape 10, on which the application of the second sealant 31 is started during the following step in which the other electrical junction 12*a* is sealed, will be contaminated during the application.

Further, it became evident that if the gap L2 is no less than 0.3 mm, it is essentially the unhardened first sealant 30 that adheres to the tip of the needle 20. This phenomenon will be described with reference to FIGS. 5A and 5B.

Figure 5A:
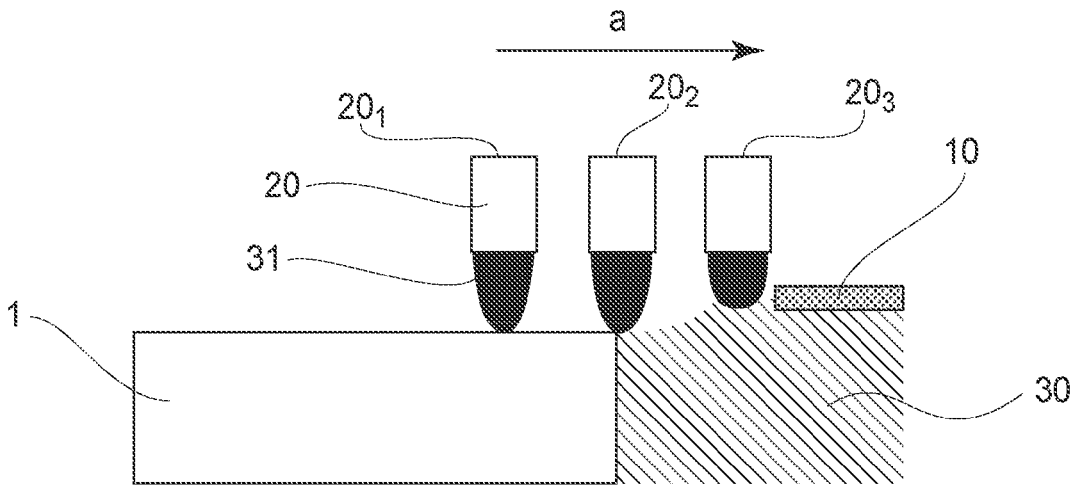
FIGS. 5A and 5B are schematic drawings which show how the second sealant is applied on the downstream (in terms of direction in which sealant application needle is moved) end portion of the area to which the second sealant is to be applied.

Referring to FIG. 5A, the needle 20 is moved from the position represented by the needle $\mathbf{20}_1$ to the position represented by the needle $\mathbf{20}_3$, with the second sealant 31 being extruded from the tip of the needle 20. During this movement of the needle 20, the needle 20 moves over the area filled with the unhardened first sealant 30. Therefore, it is possible that the first sealant 30 will adhere to the tip of the needle 20 during this movement of the needle 20. If the step for applying the second sealant 31 to the other electrical junction 12*a*, with the first sealant 30 remaining adhered to the tip of the needle 20, the second sealant 31 is not applied in a "neat" pattern.

Figure 5B:
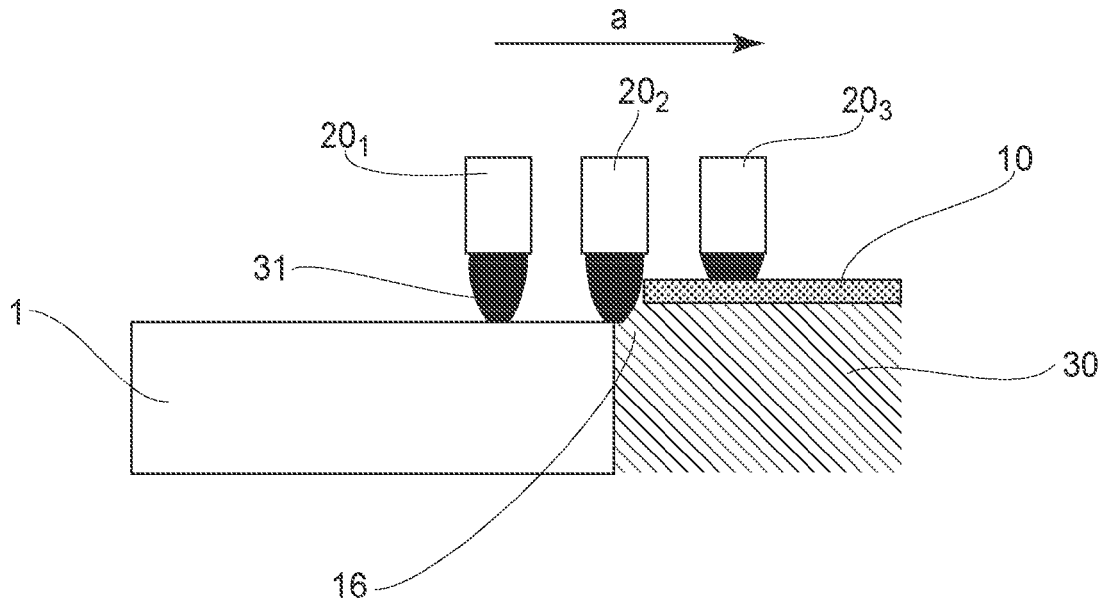

On the other hand, if the gap L2 is reduced as shown in FIG. 5B, the electrical wiring tape 10 scrapes the body of first sealant 30, along with the body of second sealant 31, away from the tip of the needle 10. Therefore, it does not occur that the step for applying the second sealant 31 to the other electrical junction 12*a* is started with the first sealant 30 remaining adhered to the tip of the needle 20. That is, the step is started with the needle 20 which has been cleaned.

The above described phenomenon occurred in the case in which the height of the step d was 0.1 mm as well as the case in which the height of the step d was 0.5 mm. It may be reasonable to think that the phenomenon occurred for the following reason. That is, the space 16, that is, the space between the edge 11*b*2 and recording element chip 1, which is on the downstream side in terms of the direction in which the second sealant 31 is applied, is filled up with the first sealant 31 before the second sealant 31 is applied. Therefore, in a case where the gap L2 is no less than 0.1 mm, the unhardened first sealant 30 adheres to the tip of the needle 20.

Also in this embodiment, it is possible to start the application of the second sealant 31 without waiting for the hardening of the body of the applied first sealant 30. However, if the second sealant 31, that is, the sealant which is to remain on the body of first sealant 30, is applied before the body of applied first sealant 30 hardens, it is possible that the body of applied second sealant 31 will sag into the body of the first sealant 30. Therefore, it is desired that the first and second sealants 30 and 31 are roughly the same in the shrinkage which occurs as they harden. It is also desired that the materials for the first and second sealants 30 and 31 contain a filler or fillers which make the first sealants 30 and second sealant 31 harden enough to prevent the body of hardened first sealant 30 and/or the body of hardened second sealant 31 from being dented by their contact with recording medium, which might occur during a paper jam or the like incident.

As described above, the ink jet recording head 100 in this embodiment is structured as follows. That is, it is provided with the spaces 15 and 16, which are at the upstream and downstream ends of each electrical junction 12*a*, respectively, in terms of the direction in which the second sealant 31 is applied. The spaces 15 has the gap L1 between its wall which coincides with the edge 11*b*1, and the recording element chip 1. The space 16 has the gap L2 between its wall which coincides with the edge 11*b*2, and the recording element chip 1. The space 15 which corresponds to one of the two electrical junctions 12*a*, and the space 15 which corresponds to the other electrical junction 12*a*, oppose each other diagonally across the hole 11 of the electrical wiring tape 10. The space 16 which corresponds to one of the two electrical junctions 12*a*, and the space 16 which corresponds to the other electrical junction 12*a*, also oppose each other diagonally across the hole 11 of the electrical wiring tape 10. In order to prevent the body of applied second sealant 31 from narrowing across its portion on the upstream end portion of the recording element chip 1, the gap L1, that is, the gap on the (upstream) side on which the application of the second sealant 31 is started, is made to be no less than five times the height of the step d. Further, the gap L2, that is, the gap on the side on which the application of the second sealant 31 is ended, is made to be no more than 0.1 mm. Therefore, the second sealant 31 is applied in a "neat" pattern even at the beginning of its application to the other electrical junctions 12*a*.

As described above, this embodiment of the present invention prevents the problem that when the second sealant 31 is applied to seal the electrical junctions of the ink jet recording head, the body of applied second sealant 31 narrows across its portion on the recording element chip 1, because of the presence of the step d between the electrical wiring tape 10 and recording element chip 1. Therefore, the electrical junctions 12*a* are satisfactorily covered with the second sealant 31. Further, on the side where the application of the second sealant 31 is ended, the body of second sealant 31 having adhered to the tip of the needle is scraped away from the tip by the electrical wiring tape 10. Therefore, the second sealant 31 can be "neatly" applied when it applied to the other electrical junction 12*a*, or when it is repeatedly applied to the same electrical junction 12*a*.

In other words, this embodiment of the present invention makes it possible to precisely apply sealant to the proper portion of an ink jet recording head, making it thereby possible to provide a highly reliable ink jet recording head, and a method for manufacturing a highly reliable ink jet recording apparatus.

Embodiment 2

Figure 6A:
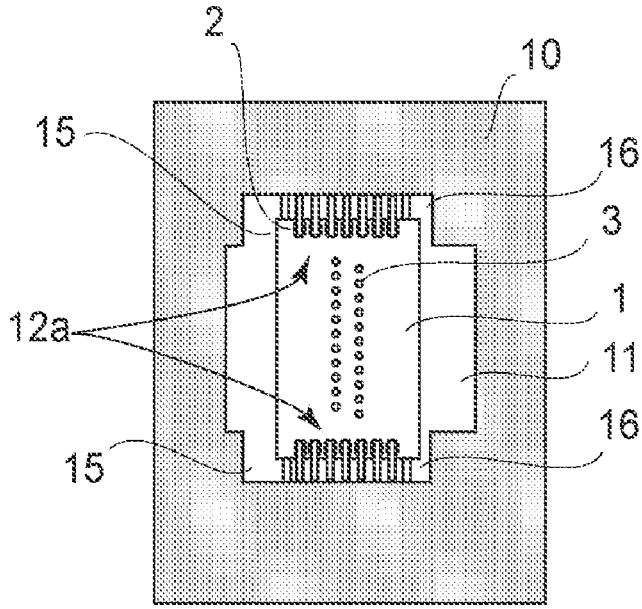
FIGS. 6A and 6B are schematic plan views of the electrical wiring portion of the ink jet recording head in the second embodiment of the present invention, before and after, respectively, the application of the sealants.
Figure 6B:
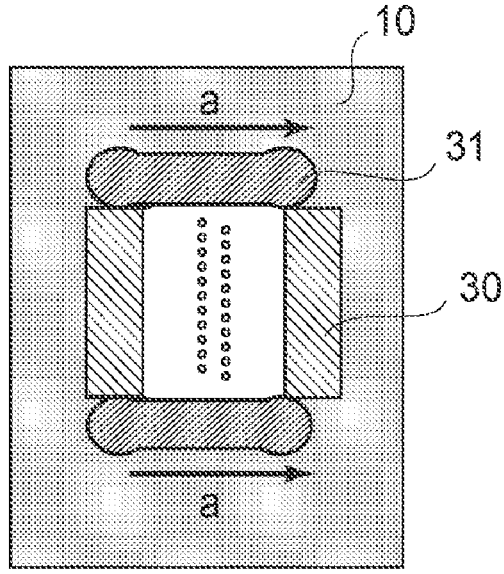
Figure 6C:
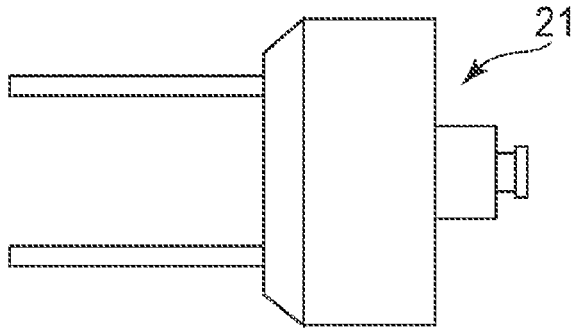
FIG. 6C is a schematic drawing of a sealant applicator with twin needles.
Figure 7A:
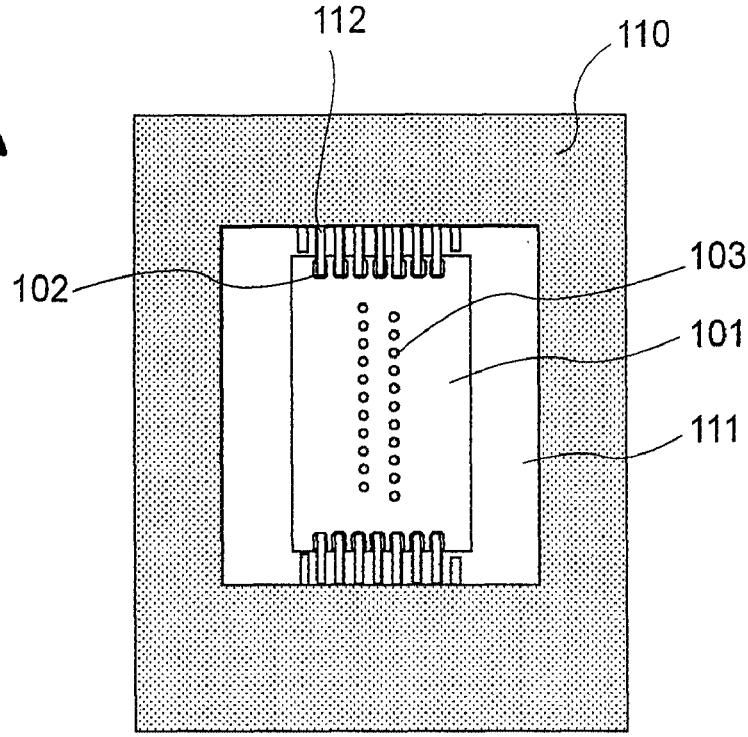
PRIOR ART FIG.7A
FIGS. 7A and 7B are schematic plan views of the electrical wiring portions of an ink jet recording head in accordance with the prior art, before and after, respectively, the application of the sealants.
Figure 7B:
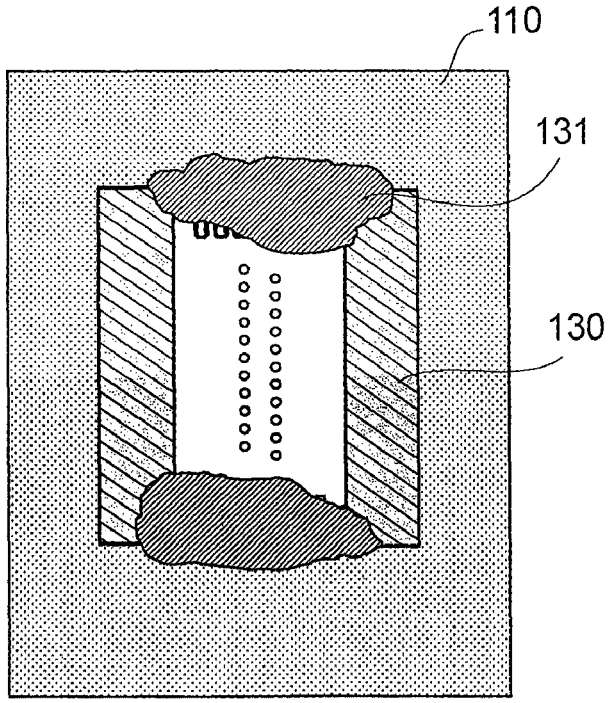

Next, referring to FIGS. 6A-6C, the second embodiment of the present invention will be described. FIG. 6A is a schematic drawing which shows the electrical junctions of the ink jet recording head in the second embodiment of the present invention, prior to the application of the sealants. FIG. 6B is a schematic drawing which shows the electrical junctions of the ink jet recording head in the second embodiment of the present invention, after the application of the sealants. FIG. 6C is a schematic drawing of an example of a sealant applicator with twin needles used in this embodiment.

In terms of the basic structures of the recording element chip 1 and electrical wiring tape 10, this embodiment is the same as the first embodiment. Therefore, the basic structures of the recording element chip 1 and electrical wiring tape 10 in this embodiment will not be described. Thus, the structural components of the ink jet recording head in this embodiment, which are the same in structure and/or function as the counterparts in the first embodiment are given the same referential symbols as those given to the counterparts, respectively.

In the first embodiment, the ink jet recording head is structured so that the two spaces 15 of the ink jet recording head, which has the gap L1, that is, the spaces on the side where the application of the second sealant is started, oppose each other diagonally across the hole 11 of the electrical wiring tape 10, and so are the two spaces 16 having the gap L2, that is, the space on the side where the application of the second sealant is ended.

In this embodiment, the ink jet recording head is structured so that the two spaces 15 of the ink jet recording head, which has the gap L1, that is, the spaces on the side where the application of the second sealant is started, are on the same side of the recording element chip 1 in terms of the direction in which the ink jet recording head is moved for image formation, and so are the two spaces 16, that is, the space on the side where the application of the second sealant is ended, as shown in FIG. 6A. This structural arrangement is mandatory to simultaneously apply the second sealant 31 to the two electrical junctions 12*a*, which are on the lengthwise edge portions of the recording element chip 1, one for one, with the use of a sealant applicator 21 with twin needles, or the like, shown in FIG. 6C.

Figure 8A:
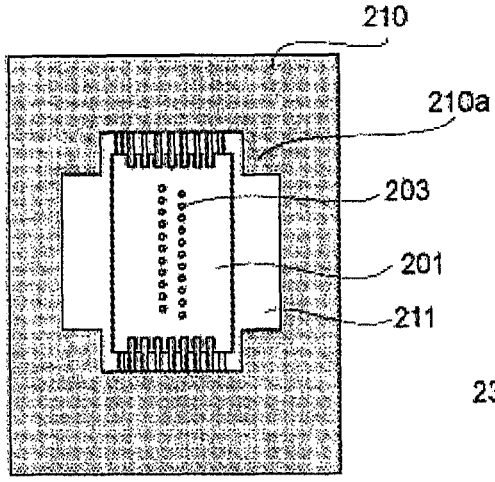
FIG. 8A is a schematic plan view of the electrical wiring portion of another ink jet recording head in accordance with the prior art, before the application of the sealants.
Figure 8C:
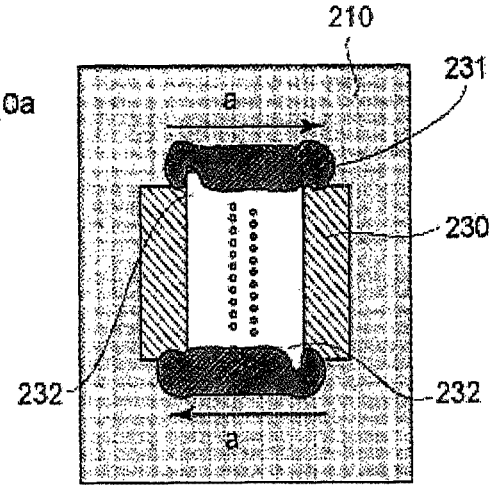
FIGS. 8B~8D are schematic plan views of the electrical wiring portion of the ink jet recording head shown in FIG. 8A, after the second sealant was applied using three different methods, one for one.
Figure 8B:
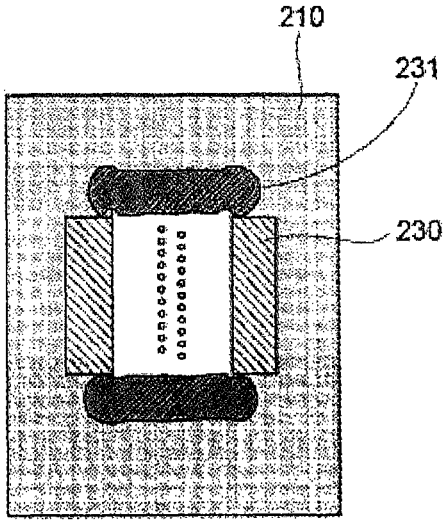
Figure 8D:
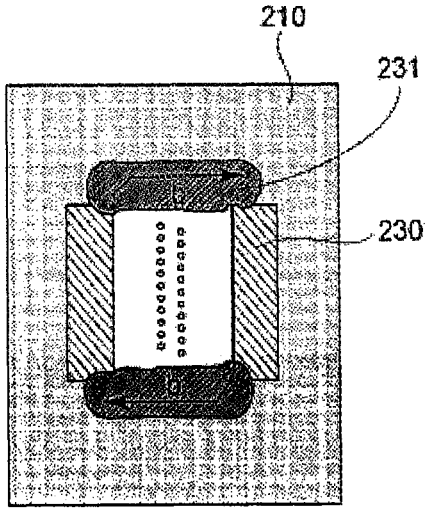
Figure 9:
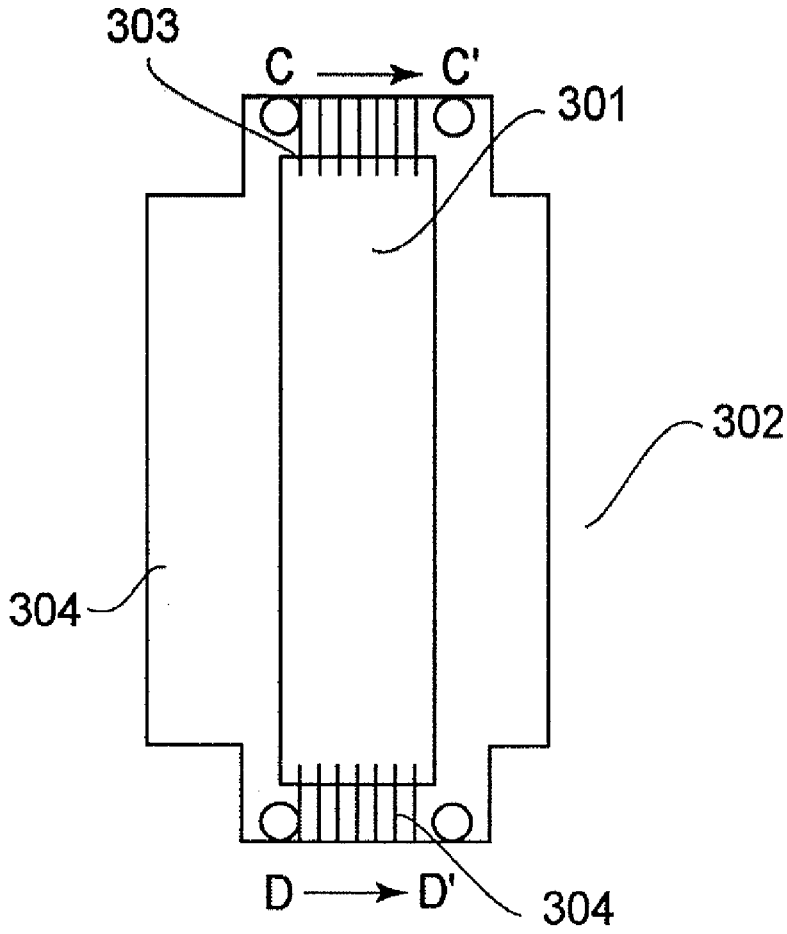
FIG. 9 is a schematic plan view of the electrical wiring portion of another ink jet recording head in accordance with the prior art, showing the general structure of the wiring portion of the ink jet recording head.

In the case of the prior art, when applying the second sealant, the needle was moved as shown in FIG. 8D in order to minimize the amount by which the body of the applied second sealant narrows across the portion on the immediately downstream side of the electrical wiring tape 10; the needle was not moved in a straight line. Therefore, it was impossible to use a sealant applicator, such as the one in this embodiment, which has twin needles. With an ink jet recording head structured as in this embodiment of the present invention, the narrowing of the body of second sealant does not occur even if the needle is moved in a straight line. In this embodiment, therefore, the second sealant can be simultaneously applied to both electrical junctions 12*a* of the ink jet recording head with the use of the abovementioned sealant applicator having twin needles. In other words, only a single step is necessary to apply the second sealant to both of the two electrical junctions 12*a* of the ink jet recording head, making it possible to reduce the sealant application step in tact time. In terms of the effect which the application of the present invention has on the portion of the body of applied second sealant, which corresponds in position to the space 15, that is, the space on the side on which the application of the second sealant is started, this embodiment is the same as the first embodiment.

Further, in this embodiment, the two areas of the ink jet recording head can be simultaneously coated by moving the sealant applicator only once. Therefore, even if the first sealant adheres to the tip of the needles, the needles can be cleaned before the applicator is used for applying the sealant to the next ink jet recording head, making it thereby possible to afford more latitude in setting the value for the gap L2 of the space 16, that is, the space on the side where the application of the sealant is ended. Obviously, in a case where the gap L2 of the ink jet recording head in this embodiment is set as in the first embodiment, the sealant having adhered to the twin needles of the sealant applicator in this embodiment are scraped away as it is in the first embodiment, making it unnecessary to clean the twin needles.

As described above, not only can this embodiment provide the same effect as that provided by the first embodiment, that is, to make it possible to precisely apply sealant to the proper portion of an ink jet recording head, making it thereby possible to provide a highly reliable ink jet recording head, and a method for manufacturing a highly reliable ink jet recording apparatus, but also, can reduce the sealant application step in tact time.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 121080/2007 filed May 1, 2007, which is hereby incorporated by reference.

What is claimed is:

1. A manufacturing method for an ink jet recording head, comprising:

a step of preparing a recording element substrate provided with energy generating means for generating energy for ejecting liquid, and a plurality of electrode portions electrically connected with the energy generating means;

a step of preparing an electric wiring member provided with a hole in which the recording element substrate is placed and a plurality of wiring leads which are electrically connected with the plurality of electrode portions, wherein a plurality of electrical connection portions, arranged in a predetermined direction, connect the plurality of electrode portions with the plurality of wiring leads, wherein a first gap between the recording element substrate and an inner edge of the hole, measured along a line passing through the plurality of electrical connection portions in the predetermined direction, is larger than a second gap between the recording element substrate and an opposite inner edge of the hole measured along the same line passing through the plurality of electrical connection portions;

a step of preparing a sealing material discharging member; and a step of applying a sealing material while moving the sealing material discharging member, along the line passing through the plurality of electrical connection portions, from a portion of the electric wiring member adjacent to the first gap, across the first gap, across the plurality of electrical connection portions, across the second gap, to a portion of the electric wiring member adjacent to the second gap.

2. A method according to claim 1, wherein the recording element substrate is prepared so that a main surface in which an ejection outlet for ejecting the liquid is disposed at a position closer to a main assembly of the ink jet recording head than a main surface of the electric wiring member, thus providing a step between the main surface of the recording element substrate and the main surface of the electric wiring member, and wherein the first gap is not less than 5 times the step.

3. A method according to claim 2, wherein when the step is approximately 0.1 mm, the first gap is not less than 0.5 mm.

4. A method according to claim 2, wherein when the step is approximately 0.05 mm, the first gap is not less than 0.3 mm.

5. A method according to claim 2, wherein when the step is not more than 0.1 mm, the second gap is not more than 0.1 mm.

6. A method according to claim 1, wherein when the plurality of electrical connection portions are provided at each of the opposing sides, the sealing material is supplied to the plurality of electrical connection portions substantially simultaneously.

* * * * *